US008957548B2

(12) United States Patent
Fuchs

(10) Patent No.: US 8,957,548 B2
(45) Date of Patent: Feb. 17, 2015

(54) CONTROLLING ANTENNA CHARACTERISTICS OF A NEAR FIELD COMMUNICATIONS (NFC) DEVICE

(75) Inventor: Franz Xaver Fuchs, Cheltenham (GB)

(73) Assignee: Broadcom Corporation, Irvine, CA (US)

( * ) Notice: Subject to any disclaimer, the term of this patent is extended or adjusted under 35 U.S.C. 154(b) by 815 days.

(21) Appl. No.: 13/173,825

(22) Filed: Jun. 30, 2011

(65) Prior Publication Data

US 2013/0002033 A1 Jan. 3, 2013

(51) Int. Cl.

| | |
|---|---|
| ***H01F 27/42*** | (2006.01) |
| ***H01Q 5/00*** | (2006.01) |
| ***H01Q 1/22*** | (2006.01) |

(52) U.S. Cl.

CPC ..... *H01Q 1/2216* (2013.01); *H01Q 5/0093* (2013.01)

USPC ..... 307/104

(58) Field of Classification Search

USPC ..... 307/104

See application file for complete search history.

(56) References Cited

U.S. PATENT DOCUMENTS

| | | | | |
|---|---|---|---|---|
| 7,515,881 | B2 | 4/2009 | Essabar | |
| 8,258,970 | B2 | 9/2012 | Charles et al. | |
| 2003/0112193 | A1* | 6/2003 | Briggs | 343/742 |
| 2009/0195361 | A1 | 8/2009 | Smith | |
| 2009/0243397 | A1* | 10/2009 | Cook et al. | 307/104 |
| 2010/0271795 | A1* | 10/2010 | Folcke et al. | 361/807 |
| 2011/0059694 | A1 | 3/2011 | Audic | |
| 2014/0076972 | A1* | 3/2014 | Smith | 235/439 |

FOREIGN PATENT DOCUMENTS

| | | | |
|---|---|---|---|
| CN | 1906863 | A | 1/2007 |
| CN | 101635577 | A | 1/2010 |

OTHER PUBLICATIONS

Chinese Office Action directed to related Chinese Patent Application No. 201210227155.X, mailed Apr. 15, 2014; 5 pages.

International Standard ISO/IEC 18092:2004(E), "Information Technology—Telecommunication and Information Exchange Systems—Near Field Communication—Interface and Protocol (NFCIP-1)," published Apr. 1, 2004; pp. 1-58.

(Continued)

*Primary Examiner* — Jared Fureman
*Assistant Examiner* — Duc M Pham
(74) *Attorney, Agent, or Firm* — Sterne, Kessler, Goldstein & Fox P.L.L.C.

(57) ABSTRACT

An apparatus and method is disclosed to control antenna characteristic of a near field communications (NFC) device. The apparatus and method may tune a resonant frequency of an antenna module of the NFC device to compensate for manufacturing tolerances of the antenna module. The NFC device may cause the antenna module to operate in a first configuration for a first period of time that is characterized by a compensation resonant frequency and a second configuration for a second period of time that is characterized by an actual resonant frequency. The NFC device causes the antenna module to continuously switch between the first configuration and the second configuration such that on average, a resonant frequency of the antenna module is approximately equal to an expected resonant frequency of the antenna module.

20 Claims, 11 Drawing Sheets

(56) References Cited

OTHER PUBLICATIONS

International Standard ISO/IEC 21481:2005(E), "Information Technology—Telecommunications and Information Exchange Between Systems—Near Field Communication—Interface and Protocol—2 (NFCIP-2)," published Jan. 15, 2005; pp. 1-5.

Taiwanese Office Action directed toward related Taiwanese Application No. TW 101122405, dated Nov. 21, 2014; 7 pages.

* cited by examiner

CONTROLLING ANTENNA CHARACTERISTICS OF A NEAR FIELD COMMUNICATIONS (NFC) DEVICE

BACKGROUND

1. Field of Invention

The invention relates to near field communications (NFC), and more specifically to tuning an antenna of a NFC device.

2. Related Art

Near field communication (NFC) devices are being integrated into communication devices, such as mobile devices to provide an example, to facilitate the use of these communication devices in conducting daily transactions and facilitate cordless power transfer. For example, instead of carrying numerous credit cards, the credit information provided by these credit cards could be stored onto a NFC device. The NFC device is simply tapped to a credit card terminal to relay the credit information to it to complete a transaction. As another example, a ticketing writing system, such as those used in bus and train terminals, may simply write ticket fare information onto the NFC device instead of providing a ticket to a passenger. The passenger simply taps the NFC device to a reader to ride the bus or the train without the use of a paper ticket.

Generally, NFC requires that NFC devices to be present within a relatively small distance from one another so that their corresponding magnetic fields can exchange information and transfer power. Typically, a first NFC device transmits or generates a magnetic field modulated with the information or requests for information, such as the credit information or the ticket fare information. This magnetic field inductively couples the information and power onto a second NFC device that is proximate to the first NFC device. The first NFC device conventionally uses amplitude modulation (AM) and/or phase modulation (PM) of the radio frequency (RF) field that it transmits or generates. The second NFC device may respond to the first NFC device by inductively coupling its corresponding information onto the first NFC device where the second NFC device modifies the load that it presents to the RF magnetic field.

Conventionally, the information is modulated onto a carrier frequency of 13.56 MHz. The first NFC device and the second NFC device each include an antenna system that is ideally tuned to a specific frequency. The first NFC device acting as the reader is tuned to 13.56 MHz while the second NFC device acting as a passive tag is tuned to a higher frequency. The antenna systems may include a series resonant LC antenna circuit and/or a parallel resonant LC circuit. For example, the first NFC device may use the series resonant LC antenna circuit, while the second NFC device may use the parallel resonant LC circuit. However, components that are used to implement these antenna systems may be affected by the manufacturing tolerances which cause their actual values to differ from their expected values. As a result, the antenna system may be actually tuned to a different resonant frequency than expected.

Conventionally, the antenna systems that are designed to be tuned and/or also antenna systems that are not designed to be tuned, may have improved performance by selecting appropriate external components, to compensate for the manufacturing tolerances. The use of high precision components and/or resonant network trimming in production may mitigate against the effects of variations in manufacturing tolerances but at an increased cost and an increase in the complexity of the NFC device. Manual and/or machine trimming may also be used to mitigate against the effects of variations in manufacturing tolerances but further increasing the cost and complexity of the NFC device.

Thus, there is a need for a way to tune a NFC device so that such tuning is effective but inexpensive in the manufacturing of NFC devices. Further aspects and advantages of the invention will become apparent from the detailed description that follows.

BRIEF DESCRIPTION OF THE DRAWINGS/FIGURES

Embodiments of the invention are described with reference to the accompanying drawings. In the drawings, like reference numbers indicate identical or functionally similar elements. Additionally, the left most digit(s) of a reference number identifies the drawing in which the reference number first appears.

Figure 1:
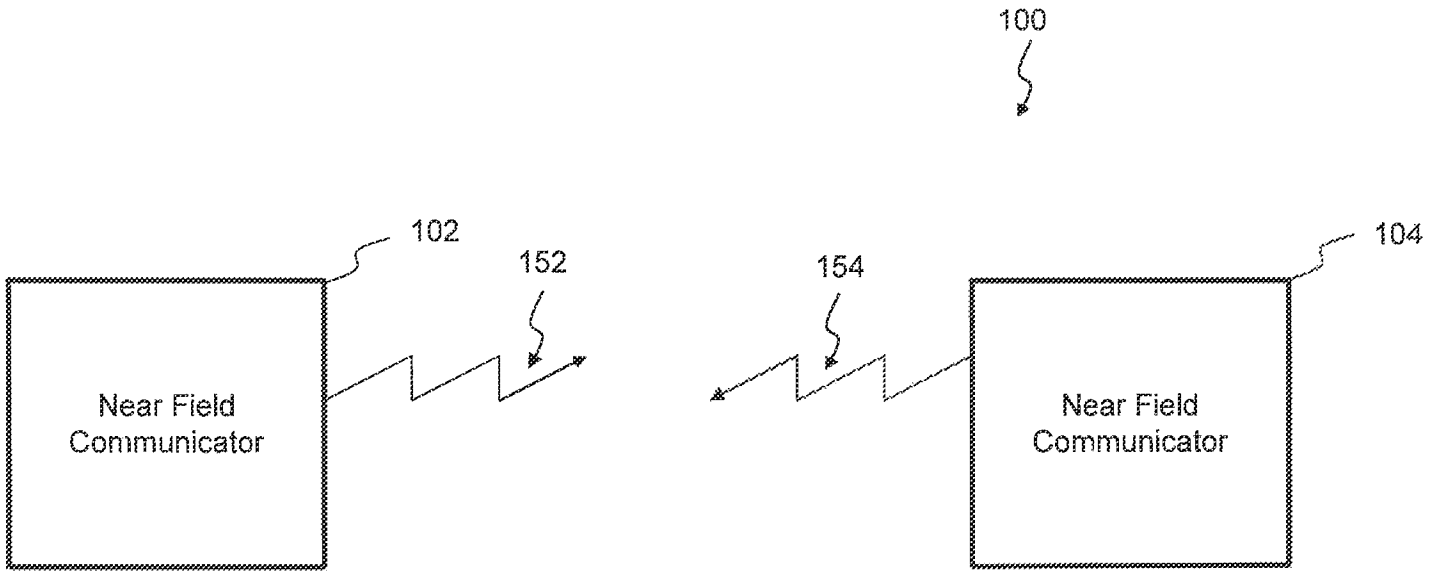
FIG. 1 illustrates a block diagram of a NFC environment according to an exemplary embodiment of the invention.

The invention will now be described with reference to the accompanying drawings. In the drawings, like reference numbers generally indicate identical, functionally similar, and/or structurally similar elements. The drawing in which an element first appears is indicated by the leftmost digit(s) in the reference number.

DETAILED DESCRIPTION OF THE INVENTION

The following Detailed Description refers to accompanying drawings to illustrate exemplary embodiments consistent with the invention. References in the Detailed Description to "one exemplary embodiment," "an exemplary embodiment," "an example exemplary embodiment," etc., indicate that the exemplary embodiment described may include a particular feature, structure, or characteristic, but every exemplary embodiment may not necessarily include the particular feature, structure, or characteristic. Moreover, such phrases are not necessarily referring to the same exemplary embodiment. Further, when a particular feature, structure, or characteristic is described in connection with an exemplary embodiment, it is within the knowledge of those skilled in the relevant art(s) to affect such feature, structure, or characteristic in connection with other exemplary embodiments whether or not explicitly described.

The exemplary embodiments described herein are provided for illustrative purposes, and are not limiting. Other exemplary embodiments are possible, and modifications may be made to the exemplary embodiments within the spirit and scope of the invention. Therefore, the Detailed Description is not meant to limit the invention. Rather, the scope of the invention is defined only in accordance with the following claims and their equivalents.

Embodiments of the invention may be implemented in hardware, firmware, software, or any combination thereof. Embodiments of the invention may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact result from computing devices, processors, controllers, or other devices executing the firmware, software, routines, instructions, etc.

The following Detailed Description of the exemplary embodiments will so fully reveal the general nature of the invention that others can, by applying knowledge of those skilled in relevant art(s), readily modify and/or adapt for various applications such exemplary embodiments, without undue experimentation, without departing from the spirit and scope of the invention. Therefore, such adaptations and modifications are intended to be within the meaning and plurality of equivalents of the exemplary embodiments based upon the teaching and guidance presented herein. It is to be understood that the phraseology or terminology herein is for the purpose of description and not of limitation, such that the terminology or phraseology of the present specification is to be interpreted by those skilled in relevant art(s) in light of the teachings herein.

Although the description of the present invention is to be described in terms of NFC, those skilled in the relevant art(s) will recognize that the present invention may be applicable to other wireless power transfer devices that use the near field and/or the far field to facilitate power transfer without departing from the spirit and scope of the present invention. For example, although the present invention is to be described using NFC capable communication devices, those skilled in the relevant art(s) will recognize that functions of these NFC capable communication devices may be applicable to other wireless power transfer devices that use the near field and/or the far field without departing from the spirit and scope of the present invention.

An Exemplary Near Field Communications (NFC) Environment

FIG. 1 illustrates a block diagram of a NFC environment according to an exemplary embodiment of the invention. A NFC environment 100 provides wireless communication of information, such as one or more commands and/or data, among a first NFC device 102 and a second NFC device 104 that are sufficiently proximate to each other. The first NFC device 102 and/or the second NFC device 104 may be implemented as a standalone or a discrete device or may be incorporated within or coupled to another electrical device or host device such as a mobile telephone, a portable computing device, another computing device such as a personal computer, a laptop, or a desktop computer, a computer peripheral such as a printer, a portable audio and/or video player, a payment system, a ticketing writing system such as a parking ticketing system, a bus ticketing system, a train ticketing system or an entrance ticketing system to provide some examples, or in a ticket reading system, a toy, a game, a poster, packaging, advertising material, a product inventory checking system and/or any other suitable electronic device that will be apparent to those skilled in the relevant art(s) without departing from the spirit and scope of the invention.

The first NFC device 102 and/or the second NFC device 104 interact with each other to exchange the information, in a peer (P2P) communication mode or a reader/writer (R/W) communication mode. In the P2P communication mode, the first NFC device 102 and the second NFC device 104 may be configured to operate according to an active communication mode and/or a passive communication mode. The first NFC device 102 modulates its corresponding information onto a first carrier wave, referred to as a modulated information communication, and generates a first magnetic field by applying the modulated information communication to the first antenna to provide a first information communication 152. The first NFC device 102 ceases to generate the first magnetic field after transferring its corresponding information to the second NFC device 104 in the active communication mode. Alternatively, in the passive communication mode, the first NFC device 102 continues to apply the first carrier wave without its corresponding information, referred to as an unmodulated information communication, to continue to provide the first information communication 152 once the information has been transferred to the second NFC device 104.

The first NFC device 102 is sufficiently proximate to the second NFC device 104 such that the first information communication 152 is inductively coupled onto a second antenna of the second NFC device 104. The second NFC device 104 demodulates the first information communication 152 to recover the information. The second NFC device 104 may respond to the information by modulating its corresponding information onto a second carrier wave and generating a second magnetic field by applying this modulated information communication to the second antenna to provide a second modulated information communication 154 in the active communication mode. Alternatively, the second NFC device 104 may respond to the information by modulating the second antenna with its corresponding information to modulate the first carrier wave to provide the second modulated information communication 154 in the passive communication mode.

In the R/W communication mode, the first NFC device 102 is configured to operate in an initiator, or reader, mode of operation and the second NFC device 104 is configured to operate in a target, or tag, mode of operation. However, this example is not limiting, those skilled in the relevant art(s) will recognize that the first NFC device 102 may be configured to operate in the tag mode and the second NFC device 104 may be configured to operate as in the reader mode in accordance with the teachings herein without departing from the spirit and scope of the present invention. The first NFC device 102 modulates its corresponding information onto the first carrier wave and generates the first magnetic field by applying the modulated information communication to the first antenna to provide the first information communication 152. The first NFC device 102 continues to apply the first carrier wave without its corresponding information to continue to provide the first information communication 152 once the information has been transferred to the second NFC device 104. The first NFC device 102 is sufficiently proximate to the second NFC device 104 such that the first information communication 152 is inductively coupled onto a second antenna of the second NFC device 104.

The second NFC device 104 derives or harvests power from the first information communication 152 to recover, to process, and/or to provide a response to the information. The second NFC device 104 demodulates the first information communication 152 to recover and/or to process the information. The second NFC device 104 may respond to the information by modulating the second antenna with its corresponding information to modulate the first carrier wave to provide the second modulated information communication.

Further operations of the first NFC device 102 and/or the second NFC device 104 may be described in International Standard ISO/IE 18092:2004(E), "Information Technology—Telecommunications and Information Exchange Between Systems—Near Field Communication—Interface and Protocol (NFCIP-1)," published on Apr. 1, 2004 and International Standard ISO/IE 21481:2005(E), "Information Technology—Telecommunications and Information Exchange Between Systems—Near Field Communication—Interface and Protocol-2 (NFCIP-2)," published on Jan. 15, 2005, each of which is incorporated by reference herein in its entirety.

A First Exemplary NFC Device

Figure 2:
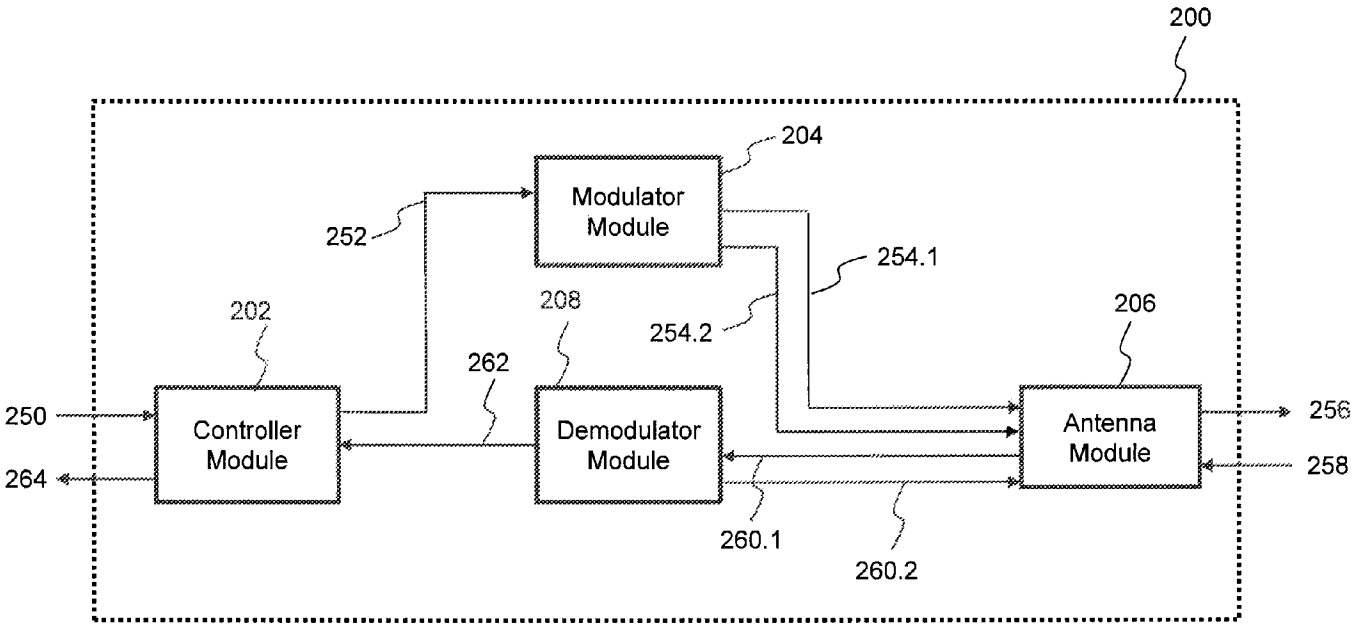
FIG. 2 illustrates a block diagram of a first NFC device that is implemented as part of the NFC environment according to an exemplary embodiment of the invention.

FIG. 2 illustrates a block diagram of a first NFC device that is implemented as part of the NFC environment according to an exemplary embodiment of the invention. A NFC device 200 is configured to operate in a reader mode of operation to initiate an exchange of information, such as data and/or one or more commands to provide some examples, with other NFC devices. The NFC device 200 includes a controller module 202, a modulator module 204, an antenna module 206, and a demodulator module 208. The NFC device 200 may represent an exemplary embodiment of the first NFC device 102 and/or the second NFC device 104.

The controller module 202 controls overall operation and/or configuration of the NFC device 200. The controller module 202 receives information 250 from one or more data storage devices such as one or more contactless transponders, one or more contactless tags, one or more contactless smartcards, any other machine-readable mediums that will be apparent to those skilled in the relevant art(s) without departing from the spirit and scope of the invention, or any combination thereof. The other machine-readable medium may include, but is not limited to, read only memory (ROM), random access memory (RAM), magnetic disk storage media, optical storage media, flash memory devices, electrical, optical, acoustical or other forms of propagated signals such as carrier waves, infrared signals, digital signals to provide some examples. The controller module 202 may also receive the information 250 from a user interface such as a touch-screen display, an alphanumeric keypad, a microphone, a mouse, a speaker, any other suitable user interface that will be apparent to those skilled in the relevant art(s) without departing from the spirit and scope of the invention to provide some examples. The controller module 202 may further receive the information 250 from other electrical devices or host devices coupled to the NFC device 200.

Typically, the controller module 202 provides the information 250 as transmission information 252 for transmission to another NFC capable device. However, the controller module 202 may also use the information 250 to control the overall operation and/or configuration of the NFC device 200. For example, the controller module 202 may issue and/or execute the one or more commands in accordance with the data, if appropriate, to control operations of the NFC device 200, such as a transmission power, a transmission data rate, a transmission frequency, a modulation scheme, a bit and/or a byte encoding scheme and/or any other suitable operation parameter that will be apparent to those skilled in the relevant art(s) without departing from the spirit and scope of the invention, of other NFC capable devices.

Additionally, the controller module 202 may format the information 250 into information frames and may perform error encoding, such as cyclic redundancy check (CRC) to provide an example, on the information frames to provide the transmission information 252. The information frames may include frame delimiters to indicate a start and/or an end of each of the information frames. The controller module 202 may additionally arrange multiple information frames to form sequences of information frames to synchronize and/or to calibrate the NFC device 200 and/or another NFC capable device. The sequences may include sequence delimiters to indicate a start and/or an end of each of the sequences.

Further, the controller module 202 may perform other functionality as described in International Standard ISO/IE 18092:2004(E), "Information Technology—Telecommunications and Information Exchange Between Systems—Near Field Communication—Interface and Protocol (NFCIP-1)," published on Apr. 1, 2004 and International Standard ISO/IE 21481:2005(E), "Information Technology—Telecommunications and Information Exchange Between Systems—Near Field Communication—Interface and Protocol-2 (NFCIP-2)," published on Jan. 15, 2005, each of which is incorporated by reference herein in its entirety.

The modulator module 204 modulates the transmission information 252 onto a carrier wave, such as a radio frequency carrier wave, having a frequency of approximately 13.56 MHz to provide an example, using any suitable analog or digital modulation technique to provide a modulated information communication 254. The modulated information communication may represent a differential communications signal having a first component 254.1 and a second component 254.2. The suitable analog or digital modulation technique may include amplitude modulation (AM), frequency modulation (FM), phase modulation (PM), phase shift keying (PSK), frequency shift keying (FSK), amplitude shift keying (ASK), quadrature amplitude modulation (QAM) and/or any other suitable modulation technique that will be apparent to those skilled in the relevant art(s). The modulator module 204 may continue to provide the carrier wave to provide an unmodulated information communication as the first component of 254.1 and the second component 254.2 of the transmission information 254 once the transmission information 252 has been transferred to another NFC capable device. Alternatively, the modulator module 204 may cease to provide the first component of 254.1 and the second component 254.2 of the transmission information 254 once the transmission information 252 has been transferred to another NFC capable device.

The antenna module 206 applies the first component of 254.1 and the second component 254.2 of the transmission information 254 to an inductive coupling element, such as a resonant tuned circuit to provide an example, to generate a magnetic field to provide a transmitted information communication 256. Additionally, another NFC capable device may inductively couple a received communication signal 258 onto the inductive coupling element to provide a recovered communication signal 260. The recovered communication signal 260 may represent a differential communications signal having a first component 260.1 and a second component 260.2. For example, this other NFC capable device may respond to the information by modulating the carrier wave inductively coupled onto its corresponding antenna with its corresponding information to provide the received communication signal 258. As another example, this other NFC capable device may modulate its corresponding information onto its corresponding carrier wave and generate its corresponding magnetic field by applying this modulated information communication to its corresponding antenna to provide the received communication signal 258.

The demodulator module 208 demodulates the first component 260.1 and the second component 260.2 of the recovered communication signal 260 using any suitable analog or digital modulation technique to provide reception information 262. The suitable analog or digital modulation technique may include amplitude modulation (AM), frequency modulation (FM), phase modulation (PM), phase shift keying (PSK), frequency shift keying (FSK), amplitude shift keying (ASK), quadrature amplitude modulation (QAM) and/or any other suitable modulation technique that will be apparent to those skilled in the relevant art(s).

Typically, the controller mode provides the reception information 262 as recovered information 266 to the data store, the user interface, and/or other electrical devices or host devices. However, the controller module 202 may also use the reception information 262 to control the overall operation and/or configuration of the NFC device 200. The reception information 262 may include one or more commands and/or data. The controller module 202 may issue and/or execute the one or more commands to control the overall operation and/or configuration of the NFC device 200. For example, the controller module 202 may issue and/or execute the one or more commands in accordance with the data, if appropriate, to control operations of the NFC device 200, such as a transmission power, a transmission data rate, a transmission frequency, a modulation scheme, a bit and/or a byte encoding scheme and/or any other suitable operation parameter that will be apparent to those skilled in the relevant art(s) without departing from the spirit and scope of the invention, of other NFC capable devices.

Additionally, the controller module 202 formats the reception information 262 into a suitable format for transmission to the data store, the user interface, and/or other electrical devices or host devices, and may perform error decoding, such as cyclic redundancy check (CRC) decoding to provide an example, on the reception information 262 to provide recovered information 266.

Conventional Antenna Module

Figure 3A:
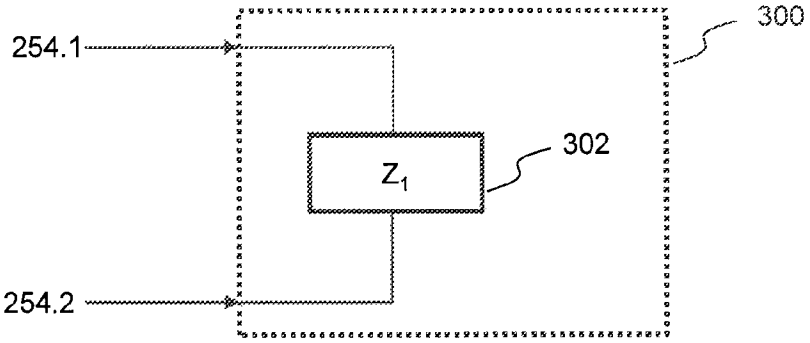
FIG. 3A (Prior Art)
FIG. 3A illustrates a block diagram of a transmission operation of a conventional antenna element.

FIG. 3A illustrates a block diagram of a transmission operation of a conventional antenna element. An antenna element 300 applies the first component of 254.1 and the second component 254.2 of the transmission information 254 to an inductive coupling element, such as a resonant tuned circuit 302 to provide an example, to generate a magnetic field to provide the transmitted information communication 256.

Figure 3B:
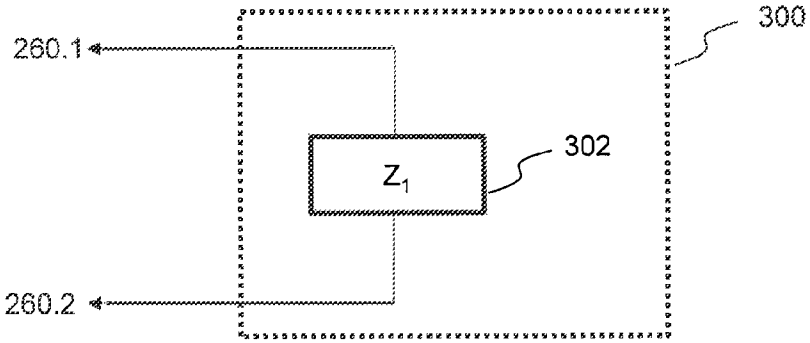
FIG. 3B (Prior Art)
FIG. 3B illustrates a block diagram of a reception operation of the conventional antenna element.

FIG. 3B illustrates a block diagram of a reception operation of the conventional antenna element. An NFC capable device may inductively couple a received communication signal 258 onto the resonant tuned circuit 302 to provide an example, of the antenna element 300 to the first component 260.1 and the second component 260.2 of the recovered communication signal 260.

As shown in FIG. 3A and FIG. 3B, the resonant tuned circuit 302 may be characterized by an impedance $Z_1$. The impedance $Z_1$ may be optimized or tuned to resonate at a specific frequency, or range of frequencies, referred to as its resonant frequency. The resonant frequency represents a frequency for a circuit, such as the resonant tuned circuit 302 to provide an example, that enables the circuit to oscillate with larger amplitude at the resonant frequency than at other frequencies. For example, the resonant tuned circuit 302 may be configured to resonate at a resonant frequency of 13.56 MHz which is the operating frequency for NFC. When the resonant tuned circuit 302 is tuned to the resonant frequency of 13.56 MHz, the resonant tuned circuit 302 may oscillate with larger amplitude at 13.56 MHz when compared to other frequencies.

When the resonant tuned circuit 302 is tuned to the resonant frequency, the inductance and the capacitance of the resonant tuned circuit 302 are optimally matched. In this situation, the magnitude of the impedance presented by the inductance matches the impedance presented by the capacitance such that each phase of the resulting impedances is perfectly opposed. For example, the resonant tuned circuit 302 may include a series resonant LC circuit. In this example, an impedance $Z_1$ of the resonant tuned circuit 302 is at a minimum when the series resonant LC circuit is tuned to the resonant frequency. The magnitude of a current through the impedance $Z_1$ of the series LC resonant circuit is at a maximum at the resonant frequency resulting in oscillation with larger amplitude by the resonant tuned circuit 302. As another example, the resonant tuned circuit 302 may include a parallel resonant LC circuit. In this example, an impedance $Z_1$ of the resonant tuned circuit 302 is at a maximum when the parallel resonant LC circuit tuned is tuned to the resonant frequency. The magnitude of a voltage across the impedance $Z_1$ of the parallel LC resonant circuit is at a maximum at the resonant frequency resulting in oscillation with larger amplitude by the resonant tuned circuit 302.

However, manufacturing tolerances of components of the resonant tuned circuit 302 may cause actual values of the components to differ from their expected values. As a result, the resonant tuned circuit 302 may be actually tuned to a different resonant frequency than expected. Therefore, when a signal having a frequency that corresponds to the expected resonant frequency is applied to the resonant tuned circuit 302, the inductance and the capacitance of the resonant tuned circuit 302 may not be optimally matched which hinders the oscillation of the resonant tuned circuit 302 and in turn weakens the performance of the resonant tuned circuit 302.

First Exemplary Antenna Module that is Implemented as Part of the First Exemplary NFC Device In a first embodiment, the present invention selectively tunes the antenna module between the actual resonant frequency and a compensation resonant frequency such that, on average, the resonant frequency of the antenna module is approximately equal to its expected resonant frequency. From the discussion above, the antenna module is designed to operate at the expected resonant frequency; however, manufacturing tolerances in the antenna module cause the actual resonant frequency of the antenna module to differ from the expected resonant frequency. In the first embodiment, the resonant frequency of the antenna module is to be continuously switched between the compensation resonant frequency and the actual resonant frequency such that, on average, the resonant frequency of the antenna module is approximately equal to its expected resonant frequency.

Additionally, selectively tuning the antenna module in this manner may be used to adjust a quality factor (Q-factor) of the antenna module. The Q-factor represents a dimensionless parameter that characterizes a bandwidth of the antenna module bandwidth relative to its resonant frequency. An antenna module with a higher Q-factor typically exhibits lower loss at its resonant frequency and is characterized as having a smaller bandwidth when compared to an antenna module with a lower Q-factor.

Figure 4A:
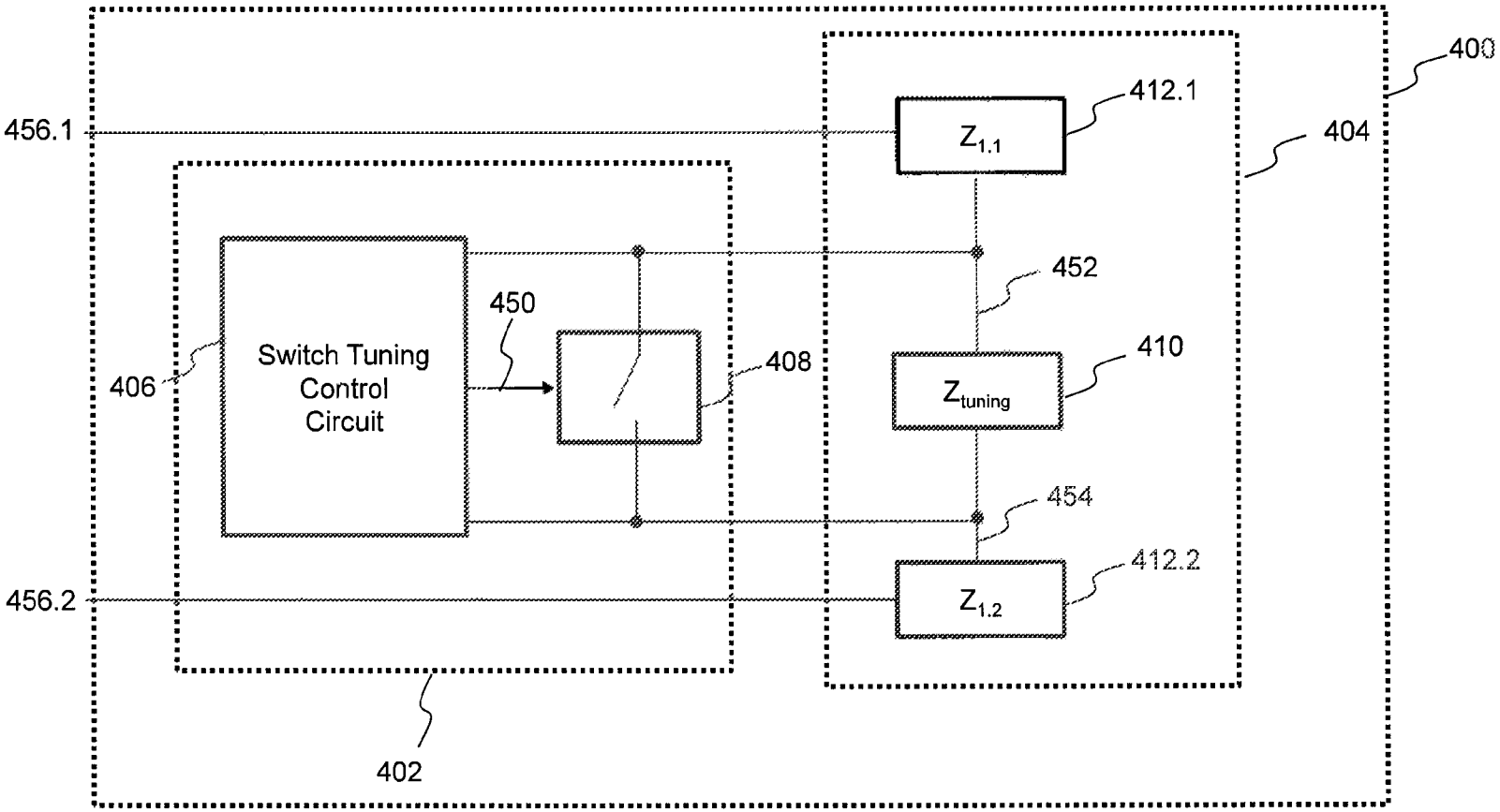
FIG. 4A illustrates a block diagram of an antenna module according to an exemplary embodiment of the invention.

FIG. 4A illustrates a block diagram of an antenna module according to an exemplary embodiment of the invention. An antenna module 400 may selectively introduce a compensation circuit into its resonant tuned circuit to tune the antenna module 400 to a compensation resonant frequency. The antenna element may selectively remove the compensation circuit from its resonant tuned circuit to tune the antenna module 400 to its actual resonant frequency. The antenna module 400 is selectively tuned between the compensation resonant frequency and the actual resonant frequency such that, on average, a resonant frequency of the antenna module 400 is approximately equal to its expected resonant frequency. The antenna module 400 includes a tuning control module 402 and a resonant tuned circuit 404. The antenna module 400 may represent an exemplary embodiment of the antenna module 206.

The tuning control module 402 causes the resonant tuned circuit 404 to selectively switch its resonant frequency between the compensation resonant frequency and its actual resonant frequency such that, on average, the resonant frequency of the resonant tuned circuit 404 is approximately equal to its expected resonant frequency. The tuning control module 402 includes a switch tuning control circuit 406 and a switching module 408.

The switch tuning control circuit 406 provides a tuning control signal 450 that causes the resonant tuned circuit 404 to operate in a first configuration that is characterized by the compensation resonant frequency for a first time period and a second configuration that is characterized by the actual resonant frequency for a second time period. Generally, the tuning control signal 450 is configured to be at a first logical level for the first time period and a second logical level for the second time period. The first time period and the second time period are chosen such that on average, a resonant frequency of the antenna module 400 is approximately equal to its expected resonant frequency. For example, for a given second time period, the first time period is given as:

$$t_c = \frac{f_e - f_a}{f_c - f_e} t_a, \tag{1}$$

where $f_e$ represents the expected resonant frequency of the antenna module 400, $f_a$ represents the actual resonant frequency of the antenna module 400, $f_c$ represents the compensation resonant frequency of the antenna module 400, $t_a$ represents the second time period and $t_c$ represents the first time period.

In the first configuration, the switching module 408 may selectively cause the introduction of a compensation circuit 410 into the resonant tuned circuit 404 to tune the resonant tuned circuit 404 to generate the compensation resonant frequency. The switching module 408 may include but not limited to an electromechanical switch, a microelectromechanical system (MEMS), a metal-oxide-semiconductor (MOS) transistor, a bipolar transistor, a varactor, a switched capacitor network, a switched inductor network and/or any other switching mechanism without departing from the spirit and scope of the present invention.

For example, as shown in FIG. 4A, the tuning control signal 450 causes the switching module 408 to be in an open or a non-conducting state to introduce the compensation circuit 410 into the resonant tuned circuit 404. The compensation circuit 410 may be implemented using one or more capacitors, one or more inductors, one or more resistors and/or any combination thereof that are arranged in a series configuration, a parallel configuration, or any combination thereof that may be characterized by an impedance $Z_{tuning}$. In an exemplary embodiment, the compensation circuit 410 is located between a first tuned circuit section 412.1 and a second tuned circuit section 412.2, namely between a node 452 and a node 454.

The switching module 408 may selectively cause the removal of the compensation circuit 410 from the resonant tuned circuit 404 to tune the resonant tuned circuit 404 to its actual resonant frequency in the second configuration. For example, as shown in FIG. 4A, the tuning control signal 450 causes the switching module 408 to be in a closed or a conducting state to effectively remove the compensation circuit 410 from the resonant tuned circuit 404. In the conducting state, the switching module 408 effectively shorts a node 452 to a node 454 to effectively remove the compensation circuit 410 from the resonant tuned circuit 404. The combined impedance of the first tuned circuit section 412.1 and a second tuned circuit section 412.2 causes the resonant tuned circuit 404 to resonate at the actual resonant frequency. The first tuned section 412.1 and the second tuned circuit section 412.2 are coupled to a first terminal 456.1 and a second terminal 456.2, respectively. The first terminal 456.1 and the second terminal 456.2 may be configured to apply a communication signal for transmission, such as the first component of 254.1 and the second component 254.2 of the transmission information 254 to provide an example, to the resonant tuned circuit 404. Alternatively, the terminal 456.1 and the second terminal 456.2 may be configured to provide a recovered communications signal, such as the first component 260.1 and the second component 260.2 of the recovered communication signal 260 to provide an example, that is inductively coupled onto the resonant tuned circuit 404.

Additionally, the switch tuning control circuit 406 may be used to adjust a current flowing through the resonant tuned circuit 404 by introducing the compensation circuit 410 and removing the compensation circuit 410 as described above. For example, the current flowing through the resonant tuned circuit 404 may be at a first level when the compensation circuit 410 is introduced into the resonant tuned circuit 404 and may be adjusted to a second level by removing the compensation circuit 410. As another example, the resonant tuned circuit 404 in a series configuration operates at a current below a maximum current at the actual resonant frequency $f_e$. The current of the resonant tuned circuit 404 increases to the maximum current when the compensation circuit 410 is periodically introduced into the resonant tuned circuit 404 for the first time period $t_c$ and removed for the second time period $t_a$.

Further, the switch tuning control circuit 406 may be used to adjust a voltage amplitude between terminal 456.1 of the first tuned circuit section 412.1 and terminal 456.2 of the second tuned circuit section 412.2 by introducing the compensation circuit 410 and removing the compensation circuit 410 as described above. For example, the voltage amplitude between terminal 456.1, of the first tuned circuit section 412.1, and terminal 456.1, of the second tuned circuit section 412.2, may be at a first level when the compensation circuit 410 is introduced into the resonant tuned circuit 404 and may be adjusted to a second level by removing the compensation circuit 410. As another example, the resonant tuned circuit 404 in a parallel configuration operates at a voltage below a maximum voltage when the compensation circuit 410 is removed from the resonant tuned circuit 404. The voltage may be increased to the maximum voltage by periodically introducing the compensation circuit 410 for the first time period $t_c$ and removing it for the second time period $t_e$.

Yet further, the switch tuning control circuit 406 may be used to adjust the Q-factor of the antenna module 400. The switch tuning control circuit 406 may monitor a voltage across the node 452 and the node 454 and/or a current that flows through the node 452 and the node 454. Typically, when the voltage across the node 452 and the node 454 and/or the current that flows through the node 452 and the node 454 are at their respective minimum magnitudes, the introduction and/or removal of the compensation circuit 410 as described above has a negligible effect on the Q-factor. However, the introduction and/or removal of the compensation circuit 410 as described above has a non-negligible effect on the Q-factor when the voltage across the node 452 and the node 454 and/or the current that flows through the node 452 and the node 454 are not at their respective minimum magnitudes. In this situation, the introduction and/or removal of the compensation circuit 410 at different voltage levels and/or current levels may be used to adjust the Q-factor of the antenna module 400 to different magnitudes.

As shown in FIG. 4A, the switch tuning control circuit 406 monitors the node 452 and the node 454 for a voltage across these nodes and/or for a current that flows through these nodes. It should be noted that the switch tuning control circuit 406 may also monitor the first terminal 456.1 and a second terminal 456.2 in a substantially similar manner. The switch tuning control circuit 406 synchronizes the tuning control signal 450 to the respective minimum magnitudes of the voltage across and/or the current that flows through the node 452 and the node 454 when no Q-factor adjustment of the antenna module 400 is necessary. For example, the voltage across and/or the current that flows through the node 452 and the node 454 may be represented as periodically varying signals that have at least one value that is approximately equal to zero. The switch tuning control circuit 406 synchronizes the tuning control signal 450 such that transitions between logical levels coincide with the voltage across and/or the current that flows through the node 452 and the node 454 being approximately equal to zero. Alternatively, the switch tuning control circuit 406 synchronizes the tuning control signal 450 to the respective non-minimum magnitudes of the voltage across and/or for the current that flows through the node 452 and the node 454 to adjust the Q-factor adjustment of the antenna module 400. The amount of Q-factor adjustment is related to the difference of the voltage across and/or for the current that flows through the node 452 and the node 454 and their respective minimum magnitudes.

The first tuned circuit section 412.1 and the second tuned circuit section 412.2 may be characterized by an impedance $Z_{1.1}$ and an impedance $Z_{1.2}$, respectively. The impedance $Z_{1.1}$ and the impedance $Z_{1.2}$ may be similar or dissimilar to each other. Typically, the impedance $Z_{1.1}$ is approximately equal to the impedance $Z_{1.2}$ such that a virtual ground is formed between the first tuned circuit section 412.1 and the second tuned circuit section 412.2. The first tuned circuit section 412.1 and the second tuned circuit section 412.2 may each be implemented using one or more capacitors, one or more inductors, one or more resistors, and/or any combination thereof. The first tuned circuit section 412.1 and the second tuned circuit section 412.2 may include configurations that include one or more capacitors. The first tuned circuit section 412.1 and the second tuned circuit section 412.2 may include configurations that include one or more capacitors but exclude inductors and/or resistors. The first tuned circuit section 412.1 and the second tuned circuit section 412.2 may include configurations that include one or more inductors. The first tuned circuit section 412.1 and the second tuned circuit section 412.2 may include configurations that include one or more inductors but exclude capacitors and/or resistors. The first tuned circuit section 412.1 and the second tuned circuit section 412.2 may be arranged in a series configuration, a parallel configuration, or any combination thereof.

Figure 4B:
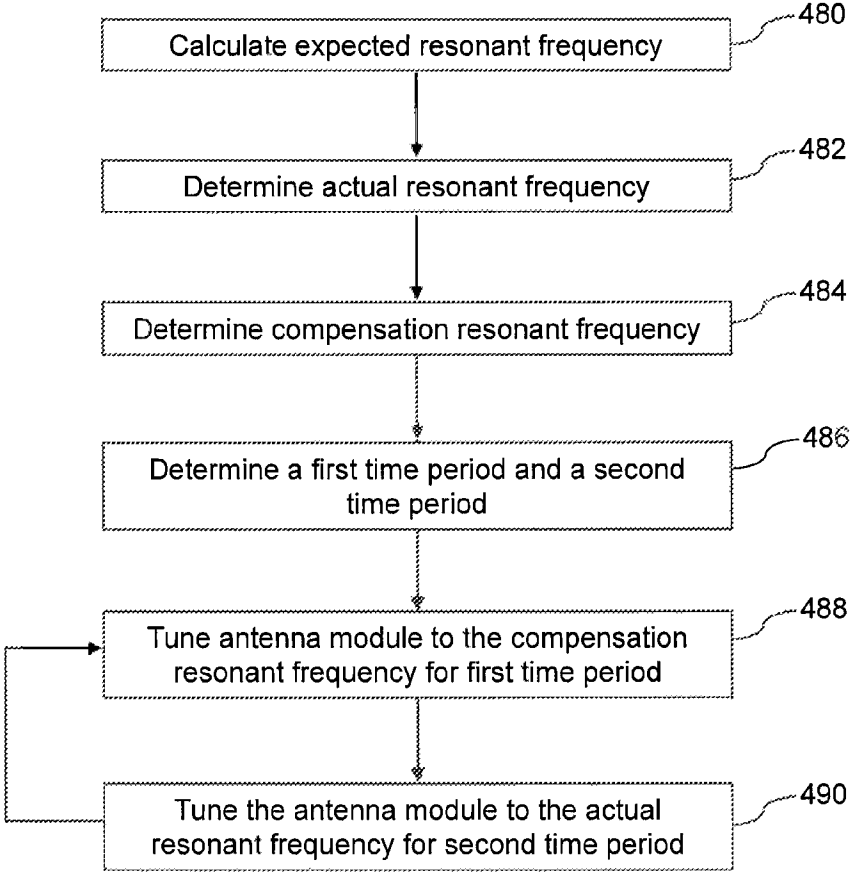
FIG. 4B is a flowchart of exemplary operational steps for tuning the antenna module according to an exemplary embodiment of the invention.

FIG. 4B is a flowchart of exemplary operational steps for tuning the antenna module according to an exemplary embodiment of the invention. The invention is not limited to this operational description. Rather, it will be apparent to persons skilled in the relevant art(s) from the teachings herein that other operational control flows are within the scope and spirit of the present invention. The following discussion describes the steps in FIG. 4B.

At step 480, the operational control flow calculates an expected resonant frequency of an antenna module, such as the antenna module 400 to provide an example. The expected resonant frequency of the antenna module represents a resonant frequency of the antenna module under ideal conditions, namely without any manufacturing tolerances in components of the antenna module.

At step 482, the operational control flow determines an actual resonant frequency of the antenna module. The actual resonant frequency of the antenna module represents a resonant frequency of the antenna module under non-ideal conditions, namely with the manufacturing tolerances in the components of the antenna module.

At step 484, the operational control flow determines a compensation resonant frequency of the antenna module. The compensation resonant frequency represents a resonant frequency of the antenna module having a compensation circuit, such as the compensation circuit 410 to provide an example.

At step 486, the operational control flow determines a first time period to tune the antenna module to the actual resonant frequency and a second time period to tune the antenna module to the compensation resonant frequency, such that, on average, a resonant frequency of the antenna module is approximately equal to its expected resonant frequency. For a given second time period, the first time period is given as:

$$t_c = \frac{f_e - f_a}{f_c - f_e} t_a, \tag{2}$$

where $f_e$ represents the expected resonant frequency of the antenna module, $f_a$ represents the actual resonant frequency of the antenna module, $f_c$ represents the compensation resonant frequency of the antenna module, $t_a$ represents the second time period and $t_c$ represents the first time period. Alternatively, for a given first time period, the second time period is given as:

$$t_a = \frac{f_c - f_e}{f_e - f_a} t_c. \quad (3)$$

At step 488, the operational control flow tunes the antenna module to the compensation resonant frequency for the first time period.

At step 490, the operational control flow tunes the antenna module to the actual resonant frequency for the second time period. The operational control flow reverts to step 488 such that the resonant frequency of the antenna module switches between the compensation resonant frequency and the actual resonant frequency such that, on average, the resonant frequency of the antenna module is approximately equal to the expected resonant frequency.

Antenna resonant frequency and Q control may be implemented in a similar fashion to the steps described above, by adjusting either the second time period $t_a$, the first time period $t_c$ and/or a combination thereof. For example, in the case of the resonant tuned circuit 404 in a series configuration, the first time period $t_c$ and/or the second time period $t_a$ may be adjusted so that the current flowing through the resonant tuned circuit 404 reaches a maximum. In another example, in the case of the resonant tuned circuit 404 in a parallel configuration, the first time period $t_c$ and/or the second time period $t_a$ may be adjusted so that the voltage amplitude between terminals 456.1 and 456.2 reaches a maximum.

Second Exemplary Antenna Module that is Implemented as Part of the First Exemplary NFC Device In a second embodiment, the present invention tunes the antenna module to the expected resonant frequency using an electrically controllable compensation circuit. From the discussion above, the antenna module is designed to operate at the expected resonant frequency; however, manufacturing tolerances in the antenna module cause the actual resonant frequency of the antenna module to differ from the expected resonant frequency. In the second embodiment, the controllable compensation circuit continuously tunes the resonant frequency of the antenna module to be approximately equal to its expected resonant frequency.

Figure 5:
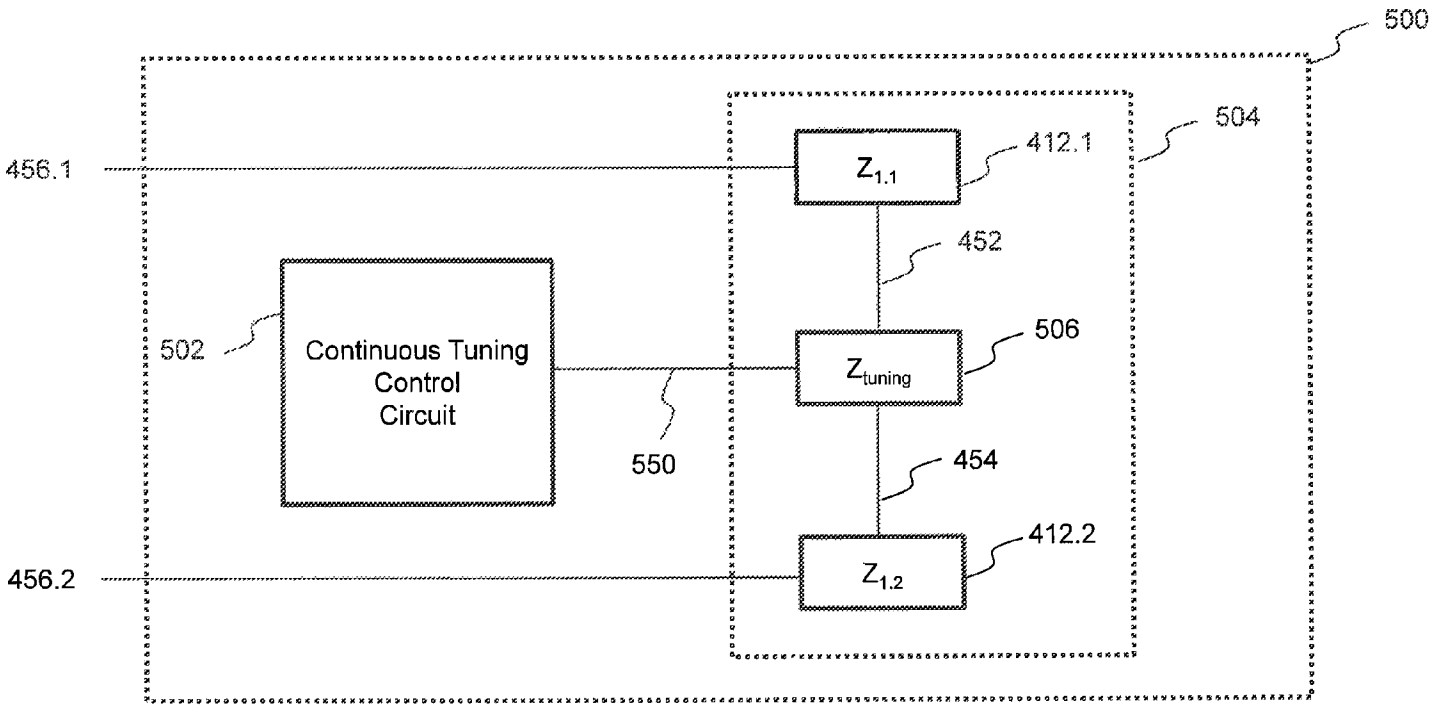
FIG. 5 illustrates a second block diagram of the antenna module according to an exemplary embodiment of the invention.

FIG. 5 illustrates a second block diagram of the antenna module according to an exemplary embodiment of the invention. An antenna module 500 may tune its actual resonant frequency to its expected resonant frequency using the electrically controllable compensation circuit. The antenna element 500 includes a continuous tuning control circuit 502 and a resonant tuned circuit 504.

The continuous tuning control circuit 502 provides a tuning control signal 550 to continuously tune the resonant frequency of the antenna module 500 to be approximately equal to its expected resonant frequency. Typically, the tuning control signal 550 represents a signal that is related to a difference between the actual resonant frequency and the expected resonant frequency. The tuning control signal 550 may include a direct current (DC) voltage signal, a DC current signal, a AC signal, a digitally encoded signal, a digitally encoded bit stream, and/or any other signal without departing from the spirit and scope of the present invention. A larger difference usually results in a larger tuning control signal 550 when compared to a smaller difference that results in a smaller tuning control signal 550.

The resonant tuned circuit 504 is continuously tuneable to adjust its resonant frequency from the actual resonant frequency to the expected resonant frequency. The resonant tuned circuit 504 includes the first tuned circuit section 412.1, the second tuned circuit section 412.2, and the compensation circuit 506. The compensation circuit 506 may be characterized by an impedance $Z_{tuning}$ that may be adjusted using the tuning control signal 550. For example, the impedance $Z_{tuning}$ may be tuned to a first impedance to adjust the resonant frequency of the resonant tuned circuit 504 to a first resonant frequency when the tuning control signal 550 is at a first level Likewise, the impedance $Z_{tuning}$ may be tuned to a second impedance to adjust the resonant frequency of the resonant tuned circuit 504 to a second resonant frequency when the tuning control signal 550 is at a second level. The first impedance and the first resonant frequency may be less than, equal to, or greater than the second impedance and the second resonant frequency, respectively. Additionally, the first impedance and the first resonant frequency may be linearly or non-linearly related to the second impedance and the second resonant frequency, respectively.

The compensation circuit 506 may be implemented using passive components, such as tuneable inductors or tuneable capacitors to provide some examples, active components, such as one or more transistors to provide an example, or any combination thereof. The compensation circuit 506 may also be implemented using continuously variable components including but not limited to electro-mechanical switches, MOS varactors, diode junctions, continuously variable inductors, continuously variable capacitors, and/or any other continuously variable component without departing from the spirit and scope of the present invention.

Third Exemplary Antenna Module that is Implemented as Part of the First Exemplary NFC Device In the first embodiment as described above, the compensation circuit 410 typically represents a static impedance which may not be dynamically adjusted. Adjustment of the impedance of the compensation circuit 410 typically requires physical replacement of the compensation circuit 410 with another compensation circuit and/or the addition of appropriate external components to the compensation circuit 410. However, in a third embodiment, the present invention may dynamically adjust an impedance of a compensation circuit without replacement and/or addition of external components.

Figure 6:
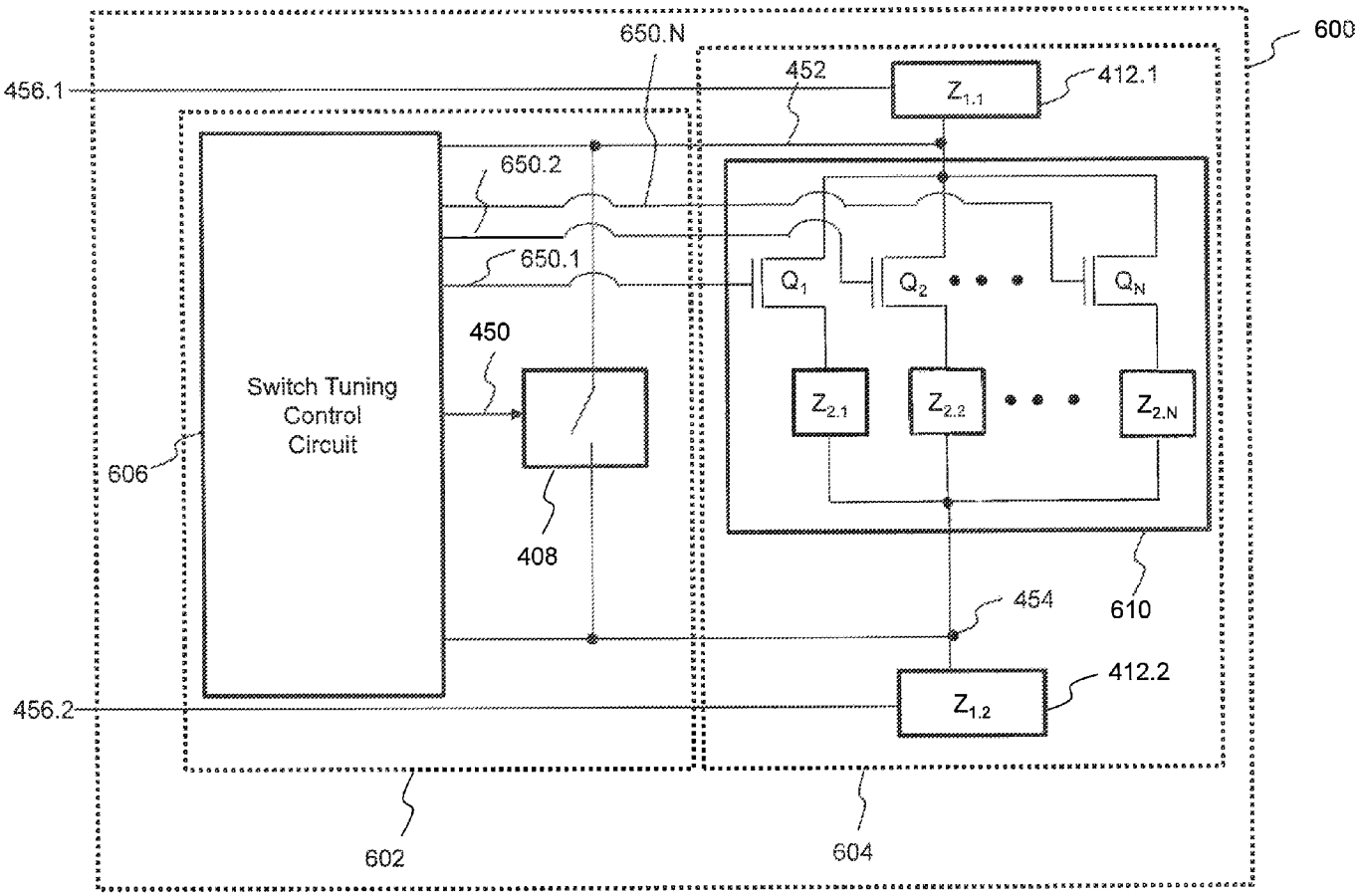
FIG. 6 illustrates a third block diagram of the antenna module according to an exemplary embodiment of the invention.

FIG. 6 illustrates a third block diagram of the antenna module according to an exemplary embodiment of the invention. An antenna module 600 includes a tuning control module 602 and a resonant tuned circuit 604. The antenna module 600 shares many similar features with the antenna module 400; therefore the only differences between the antenna module 400 and the antenna module 600 are to be discussed in further detail.

The tuning control module 602 provides the tuning signal 450 to causes the resonant tuned circuit 604 to operate in the first configuration or the second configuration as described above. The tuning control module 602 also provides tuning control signals 650.1 through 650.N to allow for a dynamic adjustment of an impedance of the antenna module 600. The dynamic adjustment offers increased flexibility to the antenna module 600 by allowing a selection of the compensation resonant frequency from among a plurality of compensation resonant frequencies.

The resonant tuned circuit 604 includes the first tuned circuit section 412.1, the second tuned circuit section 412.2, and a compensation circuit 610. The compensation circuit 610 includes impedances $Z_{2.1}$ through $Z_{2.N}$. Each of the impedances $Z_{2.1}$ through $Z_{2.N}$ are coupled to a corresponding switching transistor from among switching transistors $Q_1$ through $Q_N$.

The switch tuning control circuit 606 generates the tuning control signals 650.1 through 650.N so that the tuning control signals 650.1 through 650.N are at a first level or a second level. The switch tuning control circuit 606 activates at least one of the switching transistors $Q_1$ through $Q_N$ when its corresponding tuning control signal 650.1 through 650.N is at the first level. For example, the switch tuning control module 606 activates the switching transistor $Q_1$ when the tuning control signal 650.1 is at the first level. The switch tuning control circuit 606 deactivates at least one of the switching transistors $Q_1$ through $Q_N$ when its corresponding tuning control signal 650.1 through 650.N is at the second level. For example, the switch tuning control module 606 deactivates the switching transistor $Q_2$ when the tuning control signal 650.2 is at the second level.

A plurality of possible compensation resonant frequencies may be generated by the antenna module by activating and/or deactivating combinations of the switching transistors $Q_1$ through $Q_N$. As the switching transistors $Q_1$ through $Q_N$ are activated, each of the switching transistors $Q_1$ through $Q_N$ introduce a corresponding impedance $Z_{2.1}$, through $Z_{2.N}$ into the compensation circuit 610. For example, as the switching transistor $Q_1$ is activated, the impedance $Z_{2.1}$ is introduced to the compensation circuit 610. Similarly, as the switching transistors $Q_1$ through $Q_N$ are deactivated, each of the switching transistors $Q_1$ through $Q_N$ removes their corresponding impedance $Z_{2.1}$, through $Z_{2.N}$ from the compensation circuit 610. For example, as the switching transistor $Q_1$ is deactivated, the impedance $Z_{2.1}$ is removed from the compensation circuit 610. The overall, or effective, impedance of the compensation circuit 610 is thus determined by activating and/or deactivating combinations of the switching transistors $Q_1$ through $Q_N$.

Each of the impedances $Z_{2.1}$, through $Z_{2.N}$ may be implemented using one or more capacitors, one or more inductors, one or more resistors and/or any combination thereof that are arranged in a series configuration, a parallel configuration, or any combination thereof. Each of the impedances $Z_{2.1}$, through $Z_{2.N}$ may have substantially similar implementations or different among implementations.

Fourth Exemplary Antenna Module that is Implemented as Part of the First Exemplary NFC Device In a fourth embodiment, the present invention may adjust a quality factor (Q-factor) of the antenna module. The Q-factor may affect transient behavior of the antenna module. The greater the Q-factor of the antenna module results in the antenna module being more resistant to change. The resistance to change may manifest itself as resistance to carrier modulation. A greater Q-factor may result in distortion and/or attenuation of modulation imprinted on the carrier wave, thus hindering the transmission and/or reception of the carrier wave and modulation. Hence, controlling the Q-factor of the antenna module may be a useful tool for controlling other communications parameters such as attenuation and distortion.

Figure 7:
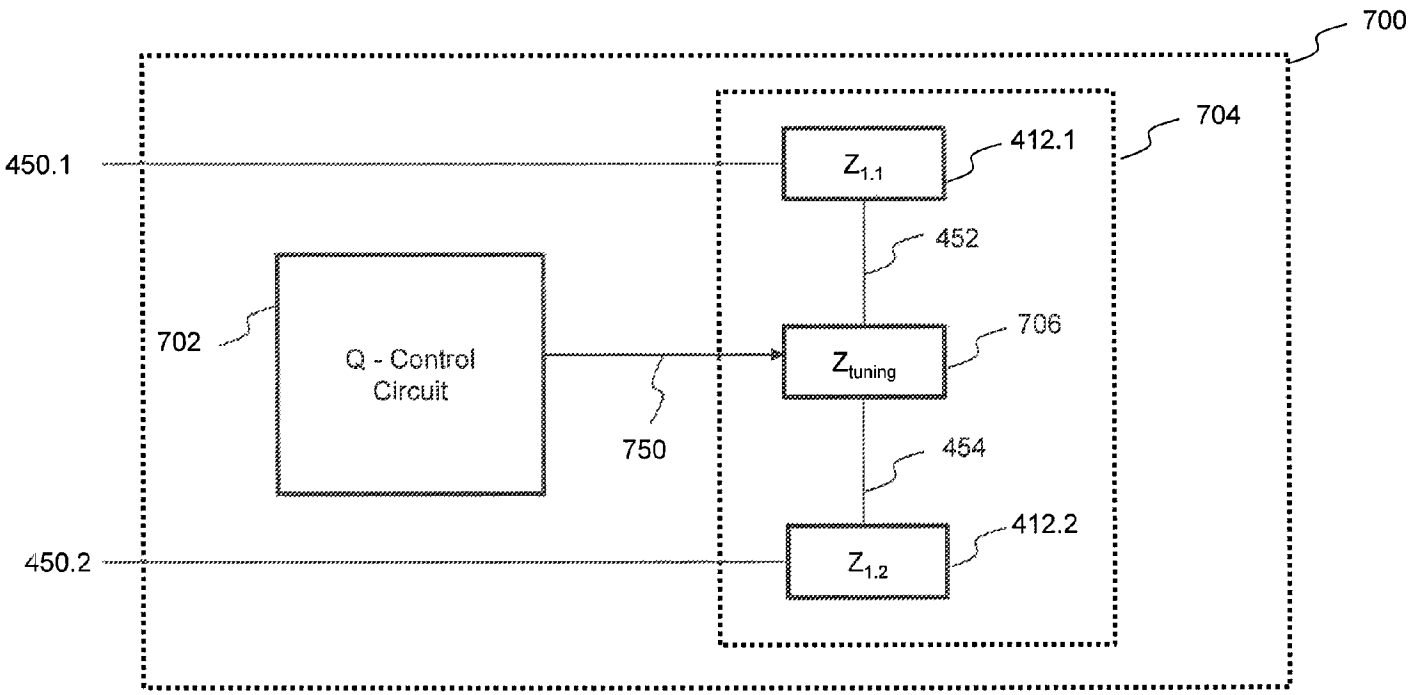
FIG. 7 illustrates a fourth block diagram of the antenna module according to an exemplary embodiment of the invention.

FIG. 7 illustrates a fourth block diagram of the antenna module according to an exemplary embodiment of the invention. An antenna module 700 may adjust its quality factor (Q-factor) to prevent the first overvoltage condition and/or the second overvoltage condition. The antenna module 700 includes a Q-control circuit 702 and a resonant tuned circuit 704.

The Q-control circuit 702 provides a Q-control signal 750 to adjust the Q-factor of the antenna module 700. The resonant tuned circuit 704 is tuneable to adjust the Q-factor of the antenna module 700. The resonant tuned circuit 704 includes the first tuned circuit section 412.1, the second tuned circuit section 412.2, and a compensation circuit 706.

The compensation circuit 706 may be characterized by an impedance $Z_{tuning}$ that may be adjusted using the tuning control signal 750. For example, the impedance $Z_{tuning}$ may be tuned to a first impedance to adjust the Q-factor of the resonant tuned circuit 704 to a first Q-factor when the tuning control signal 750 is at a first level. Likewise, the impedance $Z_{tuning}$ may be tuned to a second impedance to adjust the Q-factor of the resonant tuned circuit 704 to a second Q-factor when the tuning control signal 750 is at a second level. The first impedance may be less than, equal to, or greater than the second impedance. In an exemplary embodiment, the compensation circuit 706 is located between the first tuned circuit section 412.1 and the second tuned circuit section 412.2, namely between the node 452 and the node 454.

In an exemplary embodiment, the impedance $Z_{tuning}$ represents a real impedance such that the impedance $Z_{tuning}$ has a minimal effect upon a resonant frequency of the resonant tuned circuit 704. For example, the compensation circuit 706 may include a plurality of resistors, each of the plurality of resistors being coupled to a switch from among a plurality of switches. In this exemplary embodiment, one or more of the plurality of resistors are selected when the Q-control signal 750 activates its corresponding switch to adjust the Q-factor of the antenna module 700. The plurality of resistors may be substantially similar to each other, may be implemented using a binary differentiation between the plurality of resistors, or may be implemented using any other suitable implementation that will be apparent to those skilled in the relevant art(s) without departing from the spirit and scope of the present invention.

In another exemplary embodiment, the impedance $Z_{tuning}$ represents a complex impedance that may include a real component and an imaginary component. For example, the compensation circuit 706 may include a variable impedance, such as a transistor to provide an example, to adjust the Q-factor of the antenna module 700. In this exemplary embodiment, an impedance of the variable may be tuned to a first impedance to adjust the Q-factor of the resonant tuned circuit 704 to a first Q-factor when the tuning control signal 750 is at a first level. Likewise, the impedance $Z_{tuning}$ may be tuned to a second impedance to adjust the Q-factor of the resonant tuned circuit 704 to a second Q-factor when the tuning control signal 750 is at a second level. The first impedance may be less than, equal to, or greater than the second impedance.

Figure 8:
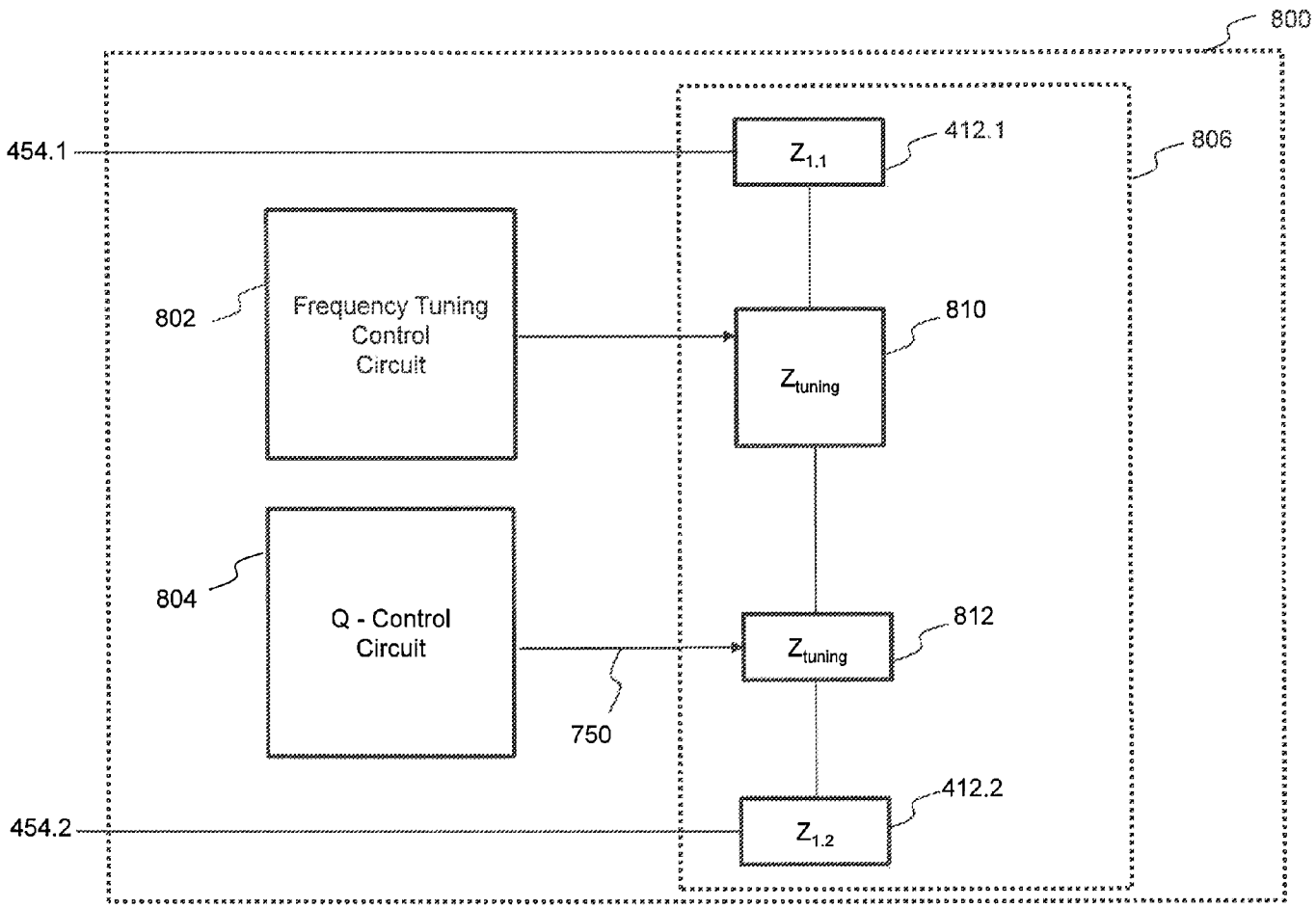
FIG. 8 illustrates a fifth block diagram of the antenna module according to an exemplary embodiment of the invention.

Fifth Exemplary Antenna Module that is Implemented as Part of the First Exemplary NFC Device FIG. 8 illustrates a fifth block diagram of the antenna module according to an exemplary embodiment of the invention. An antenna module 800 may compensate for manufacturing tolerances by switching between its actual resonant frequency and a compensation resonant frequency as described in FIG. 4A and FIG. 4B or by continuously adjusting its resonant frequency as described in FIG. 5. The antenna module 800 may adjust its quality factor (Q-factor) as described in FIG. 7. The antenna module 800 includes a frequency tuning control circuit 802, a Q-control circuit 804, and a resonant tuned circuit 806.

The frequency tuning control circuit 802 may be implemented using the tuning control module 402 or the continuous tuning control circuit 502.

The Q-control circuit 804 may be implemented using the Q-control circuit 702.

The resonant tuned circuit 806 includes the first tuned circuit section 412.1, a second tuned circuit section 412.2, a first compensation circuit 810, and a second compensation circuit 812. The first compensation circuit 810 may be implemented using the compensation circuit 410 or the compensation circuit 506. The second compensation circuit 812 may be implemented using the compensation circuit 706.

Figure 9:
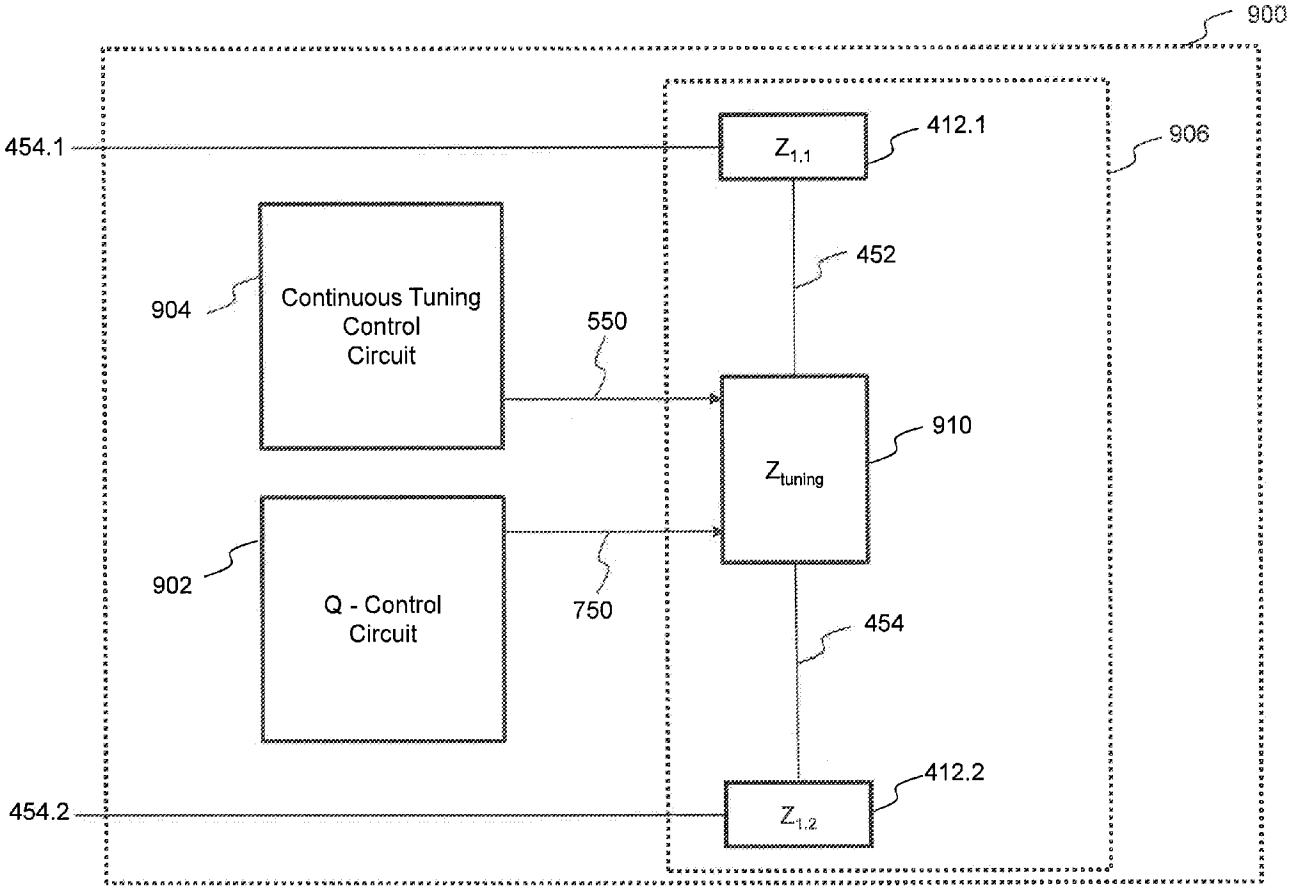
FIG. 9 illustrates a sixth block diagram of the antenna module according to an exemplary embodiment of the invention.

Sixth Exemplary Antenna Module that is Implemented as Part of the First Exemplary NFC Device FIG. 9 illustrates a sixth block diagram of the antenna module according to an exemplary embodiment of the invention. An antenna module 900 includes a Q-control circuit 902, a continuous tuning control circuit 904, and a resonant timed circuit 906. The Q-control circuit 902 may be implemented using the Q-control circuit 702. The continuous tuning control circuit 904 may be implemented using the continuous tuning control circuit 502.

The resonant tuned circuit 906 includes the first tuned circuit section 412.1, the second tuned circuit section 412.2, a compensation circuit 910. The compensation circuit 910 may be implemented using a single circuit to provide functionality of the compensation circuit 506 and the compensation circuit 706. For example, the compensation circuit 910 may be implemented using a real and/or complex impedance that is configurable to be tuned to adjust the resonant frequency and the Q-factor of the antenna module 900.

Figure 10:
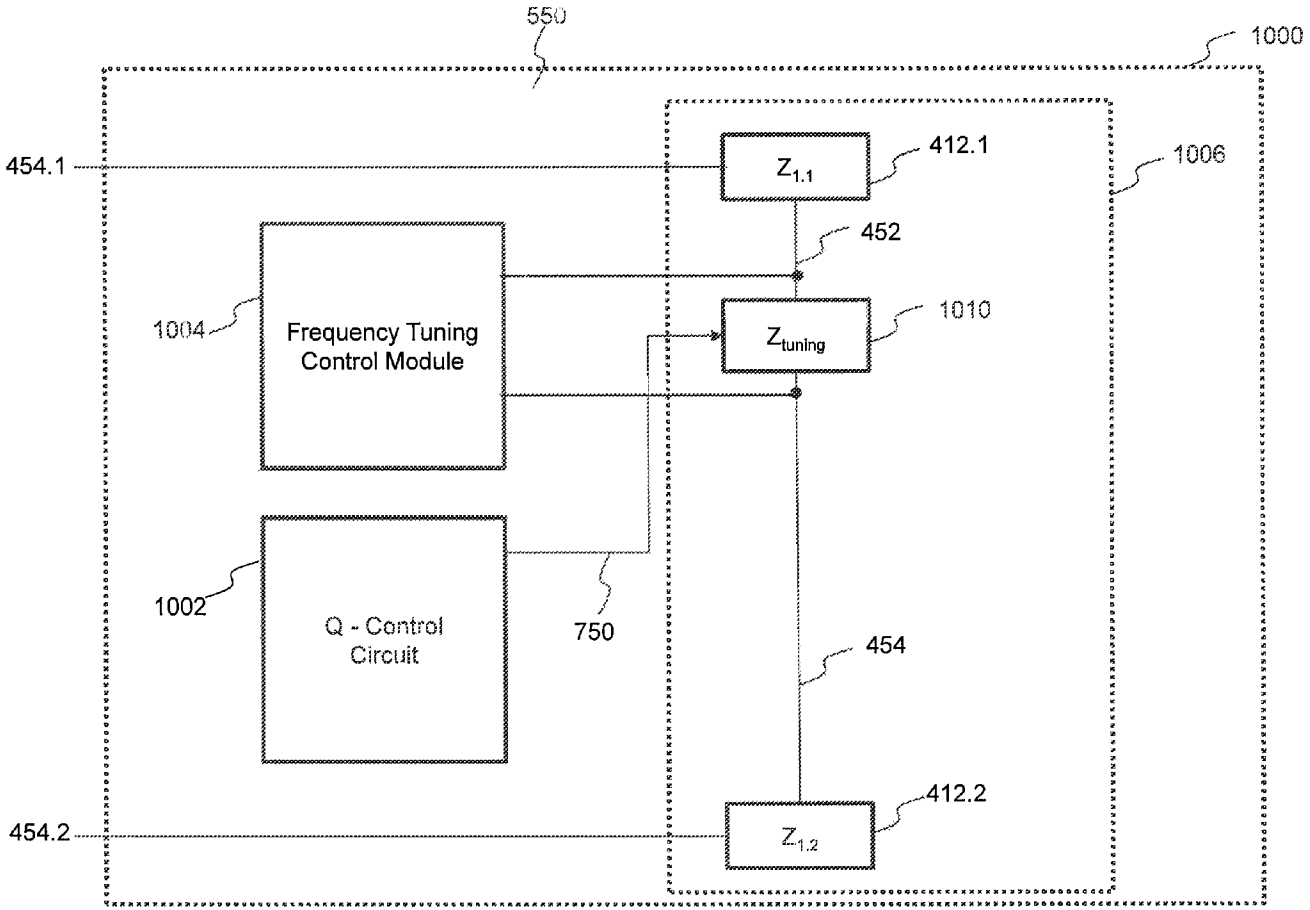
FIG. 10 illustrates a seventh block diagram of the antenna module according to an exemplary embodiment of the invention.

Seventh Exemplary Antenna Module that is Implemented as Part of the First Exemplary NFC Device FIG. 10 illustrates a seventh block diagram of the antenna module according to an exemplary embodiment of the invention. An antenna module 1000 includes a frequency tuning control module 1004, a Q-control circuit 1002, and a resonant tuned circuit 1006. The Q-control circuit 1002 may be implemented using the Q-control circuit 702. The frequency tuning control module 1004 may be implemented using the tuning control module 402.

The resonant tuned circuit 1006 includes the first tuned circuit section 412.1, the second tuned circuit section 412.2, a compensation circuit 1010. The compensation circuit 1010 may be implemented using a single circuit to provide functionality of the compensation circuit 410 and the compensation circuit 706. For example, the compensation circuit 1010 may be implemented using a real and/or complex impedance that is configurable to be tuned to adjust the resonant frequency and the Q-factor of the antenna module 1000.

CONCLUSION

It is to be appreciated that the Detailed Description section, and not the Abstract section, is intended to be used to interpret the claims. The Abstract section may set forth one or more, but not all exemplary embodiments, of the invention, and thus, are not intended to limit the invention and the appended claims in any way.

The invention has been described above with the aid of functional building blocks illustrating the implementation of specified functions and relationships thereof. The boundaries of these functional building blocks have been arbitrarily defined herein for the convenience of the description. Alternate boundaries may be defined so long as the specified functions and relationships thereof are appropriately performed.

It will be apparent to those skilled in the relevant art(s) that various changes in form and detail can be made therein without departing from the spirit and scope of the invention. Thus the invention should not be limited by any of the above-described exemplary embodiments, but should be defined only in accordance with the following claims and their equivalents.

What is claimed is:

1. An antenna module, comprising:

a resonant tuned circuit configured to operate in a first configuration and a second configuration, the first configuration being characterized as resonating at a compensation resonant frequency and the second configuration being characterized as resonating at an actual resonant frequency of the resonant tuned circuit; and a tuning control module configured to cause the resonant tuned circuit to operate in the first configuration for a first period of time and in the second configuration for a second period of time.

2. The antenna module of claim 1, wherein the resonant tuned circuit comprises:

a compensation circuit configured to be introduced into the resonant tuned circuit in the first configuration and to be removed from the resonant tuned circuit in the second configuration.

3. The antenna module of claim 2, wherein the compensation circuit is configured to be introduced into the resonant tuned circuit for the first period of time such that the resonant tuned circuit resonates at the compensation resonant frequency and to be removed from the resonant tuned circuit for the second period of time such that the resonant tuned circuit resonates at the actual resonant frequency.

4. The antenna module of claim 1, wherein manufacturing tolerances of the resonant tuned circuit cause the actual resonant frequency to differ from an expected resonant frequency of the resonant tuned circuit.

5. The antenna module of claim 4, wherein the expected resonant frequency represents a resonant frequency of the resonant tuned circuit without the manufacturing tolerances.

6. The antenna module of claim 1, wherein the tuning control module is further configured to cause the resonant tuned circuit to continuously switch between the first configuration and the second configuration such that, on average, a resonant frequency of the resonant tuned circuit is approximately equal to an expected resonant frequency of the resonant tuned circuit.

7. The antenna module of claim 6, wherein for a given second time period, the first time period is given as:

$$t_c = \frac{f_e - f_a}{f_c - f_e} t_a,$$

where $f_e$ represents the expected resonant frequency, $f_a$ represents the actual resonant frequency, $f_c$ represents the compensation resonant frequency, $t_a$ represents the second time period, and $t_c$ represents the first time period.

8. The antenna module of claim 1, wherein the tuning control module comprises:

a switch tuning control circuit configured to provide a tuning control signal at a first logical level for the first time period and at a second logical level for the second time period; and a switching module configured to cause the resonant tuned circuit to operate in the first configuration when the tuning control signal is at the first logical level and in the second configuration when the tuning control signal is at the second logical level.

9. The antenna module of claim 8, wherein the switching module is further configured to operate in a non-conducting state when the tuning control signal is at the first logical level and in a conducting state when the tuning control signal is at the second logical level.

10. The antenna module of claim 9, wherein the resonant tuned circuit comprises:

a compensation circuit configured to be introduced into the resonant tuned circuit when the switching module is operating in the non-conducting state and to be removed from the resonant tuned circuit when the switching module is operating in the conducting state.

11. The antenna module of claim 10, wherein the resonant tuned circuit includes a first node and a second node, and wherein the switching module is further configured to couple the first node to the second node in the conducting state to remove the compensation circuit from the resonant tuned circuit.

12. A method for tuning a resonant tuned circuit, comprising:

determining an actual resonant frequency of the resonant tuned circuit;

determining a compensation resonant frequency of the antenna module;

determining a first time period to tune the resonant tuned circuit to a first configuration, the first configuration being characterized as resonating at a compensation resonant frequency;

determining a second time period to tune the resonant tuned circuit to a second configuration, the second configuration being characterized as resonating at an actual resonant frequency, and tuning the resonant tuned circuit to the first configuration for the first time period and the second configuration for the second time period.

13. The method of claim 12, wherein the determining the actual resonant frequency comprises:

introducing a compensation circuit into the resonant tuned circuit for the first period of time such that the resonant tuned circuit resonates at the compensation resonant frequency, and removing the compensation circuit from the resonant tuned circuit for the second period of time such that the resonant tuned circuit resonates at the actual resonant frequency.

14. The method of claim 12, wherein the tuning the resonant tuned circuit comprises:

continuously switching between the first configuration for the first time period and the second configuration for the second time period such that, on average, a resonant frequency of the resonant tuned circuit is approximately equal to an expected resonant frequency of the resonant tuned circuit.

15. The method of claim 12, wherein the determining the first time period comprises:

determining the first time period, wherein for a given second time period, the first time period is given as:

$$t_c = \frac{f_e - f_a}{f_c - f_e} t_a,$$

where $f_e$ represents the expected resonant frequency, $f_a$ represents the actual resonant frequency, $f_c$ represents the compensation resonant frequency, $t_a$ represents the second time period and $t_c$ represents the first time period.

16. The method of claim 12, wherein the determining the second time period comprises:

determining the second time period, wherein for a given first time period, the second time period is given as:

$$t_a = \frac{f_c - f_e}{f_e - f_a} t_c,$$

where $f_e$ represents the expected resonant frequency, $f_a$ represents the actual resonant frequency, $f_c$ represents the compensation resonant frequency, $t_a$ represents the second time period and $t_c$ represents the first time period.

17. The method of claim 12, wherein the tuning the resonant tuned circuit comprises:

generating a tuning control signal at a first logical level for the first time period and at a second logical level for the second time period; and tuning the resonant tuned circuit to the first configuration when the tuning control signal is at the first logical level and to the second configuration when the tuning control signal is at the second logical level.

18. The method of claim 17, wherein the tuning the resonant tuned circuit to the first configuration when the tuning control signal is at the first logical level comprises:

operating a switching module in a non-conducting state when the tuning control signal is at the first logical level and in a conducting state when the tuning control signal is at the second logical level.

19. The method of claim 18, wherein the tuning the resonant tuned circuit to the first configuration when the tuning control signal is at the first logical level further comprises:

introducing a compensation circuit into the resonant tuned circuit when the switching module is operating in the non-conducting state; and removing the compensation circuit from the resonant tuned circuit when the switching module is operating in the conducting state.

20. The method of claim 19, wherein the resonant tuned circuit includes a first node and a second node, and wherein the removing the compensation circuit comprises:

coupling the first node to the second node in the conducting state to remove the compensation circuit from the resonant tuned circuit.

* * * * *

UNITED STATES PATENT AND TRADEMARK OFFICE

CERTIFICATE OF CORRECTION

PATENT NO. : 8,957,548 B2
APPLICATION NO. : 13/173825
DATED : February 17, 2015
INVENTOR(S) : Franz Xaver Fuchs It is certified that error appears in the above-identified patent and that said Letters Patent is hereby corrected as shown below:

In the Claims

Column 20, line 4, Claim 15, please replace “period and” with --period, and--.

Column 20, line 18, Claim 16, please replace “period and” with --period, and--.

Signed and Sealed this
Twenty-ninth Day of September, 2015

Michelle K. Lee

Michelle K. Lee
*Director of the United States Patent and Trademark Office*